US011491373B2

(12) United States Patent
Bestonzo et al.

(10) Patent No.: US 11,491,373 B2
(45) Date of Patent: Nov. 8, 2022

(54) METHOD OF UNLOCKING A CONTROL UNIT OF AN EXERCISE MACHINE AND EXERCISE MACHINE IMPLEMENTING SUCH METHOD

(71) Applicant: TECHNOGYM S.p.A., Forli'-Cesena (IT)

(72) Inventors: Marco Bestonzo, Forli'-Cesena (IT); Luca Coletti, Forli'-Cesena (IT)

(73) Assignee: TECHNOGYM S.p.A., Forli'-Cesena (IT)

( * ) Notice: Subject to any disclaimer, the term of this patent is extended or adjusted under 35 U.S.C. 154(b) by 147 days.

(21) Appl. No.: 16/894,350

(22) Filed: Jun. 5, 2020

(65) Prior Publication Data

US 2020/0384316 A1 Dec. 10, 2020

(30) Foreign Application Priority Data

Jun. 7, 2019 (IT) ..... 102019000008397

(51) Int. Cl.

| | |
|---|---|
| ***A63B 24/00*** | (2006.01) |
| ***A63B 22/02*** | (2006.01) |
| ***A63B 22/06*** | (2006.01) |
| *A63B 71/06* | (2006.01) |

(52) U.S. Cl.

CPC ..... *A63B 24/0087* (2013.01); *A63B 22/02* (2013.01); *A63B 22/0605* (2013.01); *A63B 2071/0658* (2013.01); *A63B 2220/40* (2013.01); *A63B 2220/833* (2013.01)

(58) Field of Classification Search

None

See application file for complete search history.

(56) References Cited

U.S. PATENT DOCUMENTS

2004/0162189 A1 8/2004 Hickman
2005/0026750 A1* 2/2005 Oglesby ..... A63B 24/0006 482/4

(Continued)

FOREIGN PATENT DOCUMENTS

EP 2 940 676 A1 11/2015

OTHER PUBLICATIONS

Italian Search Report for corresponding Italian Patent Application No. 10219000008397 dated Feb. 5, 2020, 7 pages.

(Continued)

*Primary Examiner* — Sundhara M Ganesan
*Assistant Examiner* — Shila Jalalzadeh Abyaneh
(74) *Attorney, Agent, or Firm* — Merchant & Gould P.C.

(57) ABSTRACT

A method for unlocking a control unit of an exercise machine includes providing the exercise machine, having at least one sensor for detecting presence of a user on the exercise machine, with at least one electrical signal representative of a detection carried out at the time of the occupation of the exercise machine by a user. The method further includes switching, by the exercise machine, the control unit of the exercise machine from a first locking condition to at least a second operating condition in which the user may issue commands to the exercise machine by the control unit, based on the at least one electrical signal provided by said at least one sensor for detecting the presence of the user on the exercise machine.

15 Claims, 8 Drawing Sheets

(56) References Cited

U.S. PATENT DOCUMENTS

| | | | | |
|---|---|---|---|---|
| 2010/0160115 | A1* | 6/2010 | Morris | A63B 22/0235 482/4 |
| 2011/0059825 | A1* | 3/2011 | McGown | G16H 20/30 702/176 |
| 2013/0304401 | A1* | 11/2013 | Tubaro | A63B 22/0242 702/41 |
| 2015/0306456 | A1* | 10/2015 | Pasini | A63B 24/0062 482/4 |
| 2015/0367175 | A1* | 12/2015 | Alessandri | A63B 24/0006 482/8 |
| 2019/0351307 | A1* | 11/2019 | Fima | A63B 71/0622 |
| 2019/0381356 | A1* | 12/2019 | Huang | A61B 5/7257 |

OTHER PUBLICATIONS

"Owner's Manual", 22 pages (Dec. 2009), retrieved from the Internet: http://www.lafitness.co.nz/images/pdf/CycloneManual/pdf.

* cited by examiner

METHOD OF UNLOCKING A CONTROL UNIT OF AN EXERCISE MACHINE AND EXERCISE MACHINE IMPLEMENTING SUCH METHOD

This application claims benefit of Ser. No. 102019000008397, filed 7 Jun. 2019 in Italy and which application is incorporated herein by reference. To the extent appropriate, a claim of priority is made to the above disclosed application.

FIELD OF THE INVENTION

The present invention relates to the field of fitness and, in particular, to a method for unlocking a control unit of an exercise machine and to an exercise machine implementing such method.

TECHNOLOGICAL BACKGROUND OF THE INVENTION

Nowadays, an exercise machine is equipped with a respective control unit, for example in touchscreen technology, to allow the user to control the exercise machine which may be used for training, by setting and/or varying, for example, parameters, functionality, workout program and so on.

If it is not used for a long period of time, beyond a set value, the exercise machine takes a stand-by condition, in which the control unit may also temporarily become locked, showing a screensaver on the respective display, or no image, whereby the display seems to be turned off.

When a user intends to train and occupies an exercise machine in the stand-by condition, it is necessary to manually unlock the control unit to enable the user to issue commands to the exercise machine.

This unlocking operation is not always intuitive as the control unit, as mentioned above, may simply show a stand-by image (still or moving screensaver) or even not show anything (apparently dark screen), in addition, without providing any suggestions or indications for the user on how to proceed quickly to unlock the control unit.

This aspect certainly represents a limitation, both in the case of users unfamiliar with technology, as well as in the case of users who, during a set training program, approach the exercise machine coming from another exercise machine, therefore, in conditions of tiredness and fatigue which may certainly affect lucidity.

SUMMARY

It is the object of the present invention to devise and provide a method for unlocking a control unit of an exercise machine which allows to at least partially overcome the drawbacks mentioned above with reference to the background art, in particular, which allows an unlocking of the control unit of the exercise machine as immediate and easy as possible.

Such an object is achieved by a method for unlocking a control unit of an exercise machine, comprising steps of:

providing the exercise machine, by at least one sensor for detecting the presence of a user on the exercise machine, with at least one electrical signal representative of a detection carried out at the time of the occupation of the exercise machine by a user;

switching, by the exercise machine, the control unit of the exercise machine from a first locking condition to at least a second operating condition in which the user may issue commands to the exercise machine by means of the control unit, on the basis of the at least one electrical signal provided by said at least one sensor for detecting the presence of the user on the exercise machine.

Preferred embodiments of said method are defined in the dependent claims.

The present invention also relates to an exercise machine comprising:

a control unit which is operable by a user to issue commands to the exercise machine, the control unit being configured to take a first locking condition and at least a second operating condition in which the user may issue commands to the exercise machine by means of the control interface;

at least one sensor for detecting the presence of the user on the exercise machine, the at least one sensor for detecting the presence of the user on the exercise machine being configured to provide the exercise machine with at least one electrical signal representative of a detection carried out at the time of the occupation of the exercise machine by a user;

the exercise machine being configured to switch the control unit of the exercise machine from a first locking condition to at least a second operating condition in which the user may issue commands to the exercise machine by means of the control unit, on the basis of the at least one electrical signal provided by said at least one sensor for detecting the presence of the user on the exercise machine.

BRIEF DESCRIPTION OF THE DRAWINGS

Further features and advantages of the method and of such an exercise machine in accordance with the invention will become apparent from the following description of preferred embodiments, given by way of explanation and not by way of limitation, with reference to the accompanying drawings, in which.

It should be noted that in the aforesaid Figures, equal or similar elements are indicated with the same numeric or alphanumeric reference.

DETAILED DESCRIPTION

With reference to the aforesaid Figures, an exercise machine 100 is now described, which may be used by a user for carrying out physical activity, in accordance with the present invention.

The exercise machine 100 may be any exercise machine which may be used by a user to carry out physical activity such as, for example, a treadmill, a bike or an exercise bike, a muscle-building apparatus, and so on.

Figure 1:
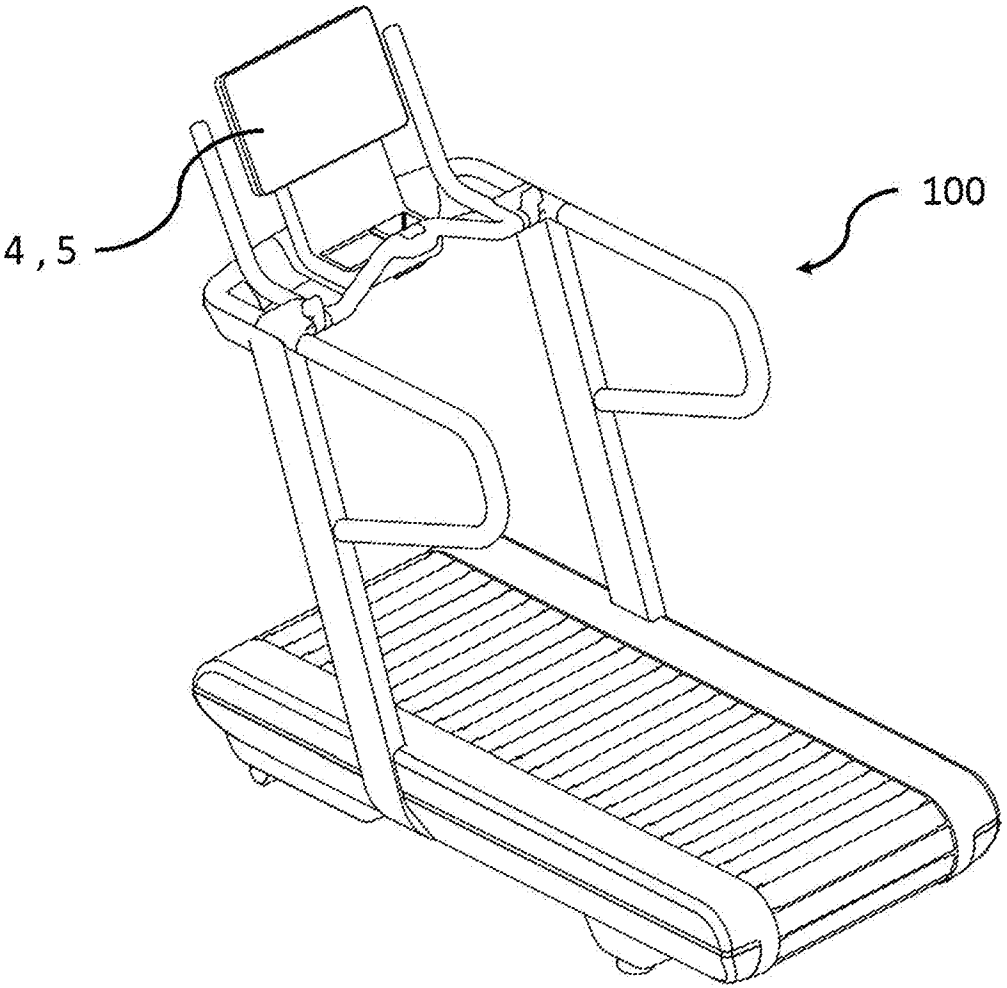
FIG. 1 shows an exercise machine in accordance with an embodiment of the present invention.

The example of an exercise machine shown in FIG. 1 is a treadmill.

The exercise machine 100 comprises a control unit 1 which is operable by the user to issue commands to the exercise machine 100.

The control unit 1 is configured to take a first locking condition and at least a second operating condition in which the user may issue commands to the exercise machine 100.

"First locking condition" means an operating condition in which the control unit 1, and therefore also the exercise machine 100, is in a stand-by mode.

In the first locking condition, the operation of the control unit 1 is disabled, therefore it is not capable of receiving commands from the user to be issued to the exercise machine 100.

It should be noted that the control unit 1 may take the first locking condition in case a set event occurs such as, for example, the inactivity of the exercise machine 100 for a set period of time or the activation by the user of a respective "stand-by" command.

"Second operating condition" means an operating condition in which the control unit 1 is enabled to receive commands from the user to be issued to the exercise machine 100.

With reference now to an embodiment, shown in any one of FIGS. 2-5, the exercise machine 100 comprises a data processing module 2, for example, a microcontroller or a microprocessor.

Furthermore, the exercise machine 100 comprises a memory module 2' operatively connected to the data processing module 2.

The memory module 2' may be inside (as diagrammatically shown in FIGS. 2-5) or outside the data processing module 2 (embodiment not shown in the Figures).

The data processing module 2, by means of the loading and execution of one or more program codes, stored in the memory module 2', is configured to carry out operations, the execution of which is delegated to the exercise machine 100.

In other words, in this embodiment, the data processing module 2 and the memory module 2' are an intelligent component with which the exercise machine 100 is equipped.

The data processing module 2 is configured to control the exercise machine 100.

For example, the data processing module 2 is configured to switch the control unit 1 from a first locking condition to said at least a second operating condition in which the user may issue commands to the exercise machine 100 by means of the control unit 1.

Furthermore, the data processing module 2 is configured to control the exercise machine 100 on the basis of the commands issued by the user to the exercise machine 100 by means of the control unit 1.

In this regard, in accordance with an embodiment, in combination with those described above, shown in any one of FIGS. 2-5, the control unit 1 further comprises a control interface 4, operatively connected to the data processing module 2, configured to allow a user to interact with the control unit 1.

In an embodiment, the control interface 4 may be of the touchscreen type.

In an embodiment, alternative to the preceding one, the control interface 4 may be a push-button keyboard.

In an embodiment, in combination with any of the preceding ones, shown in any of FIGS. 2-5, the control unit 1 further comprises a display module 5 which is operatively connected to the data processing module 2.

The display module 5 may be used by the user during interaction with the control unit 1.

In fact, the display module 5 is configured to show the user both content representative of the use of the exercise machine 100 (for example: identification screen; menu start screen for setting the workout; screen with parameters updating during the workout; workout summary screen, and so on) as well as multimedia content for entertainment during the workout (for example: Internet browsing; entertainment videos; audio/music video files, etc.).

Examples of screens which may be displayed by the display module 5 are described below with reference to FIGS. 6*a*, 6*b* and 6*c*.

Figure 6B:
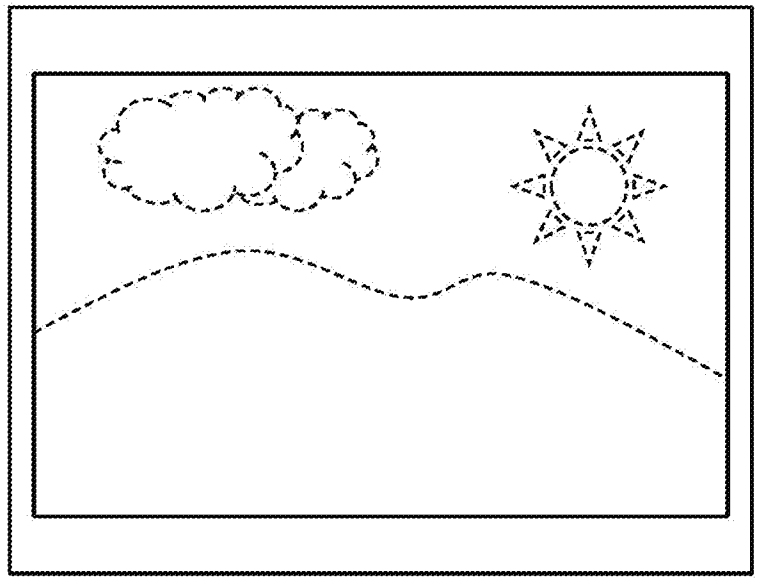
FIGS. 6*a*, 6*b* and 6*c* respectively show different screens which may be displayed by an exercise machine adapted to implement a method for unlocking a control unit of an exercise machine, according to an embodiment of the present invention.
Figure 6A:
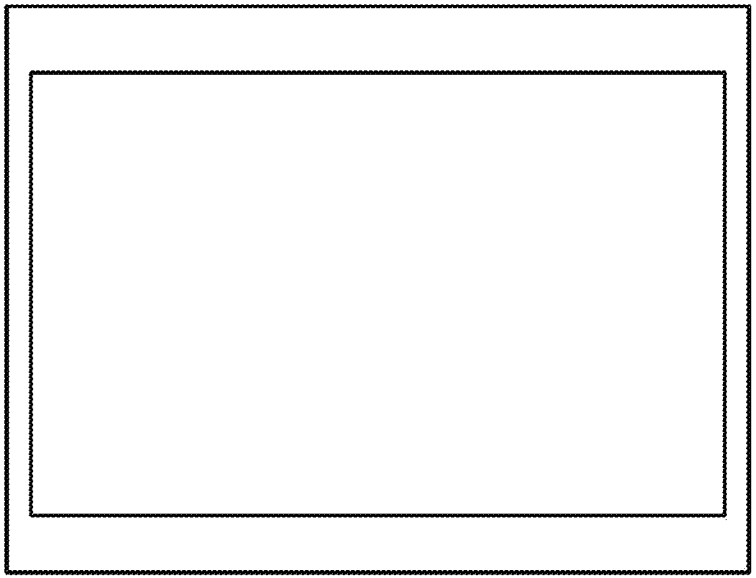

The first screen shown in FIG. 6*a* is, for example, an image devoid of any graphical element and may be viewed by the exercise machine 100 when the control unit 1 takes the first locking condition. In one example, the image may be dark, in solid color, for example, black or gray.

The second screen shown in FIG. 6*b* is, for example, a frame (represented with dashed lines) of a still or moving screensaver, which may be viewed also from the exercise machine 100 when the control unit 1 takes the first locking condition.

Figure 6C:
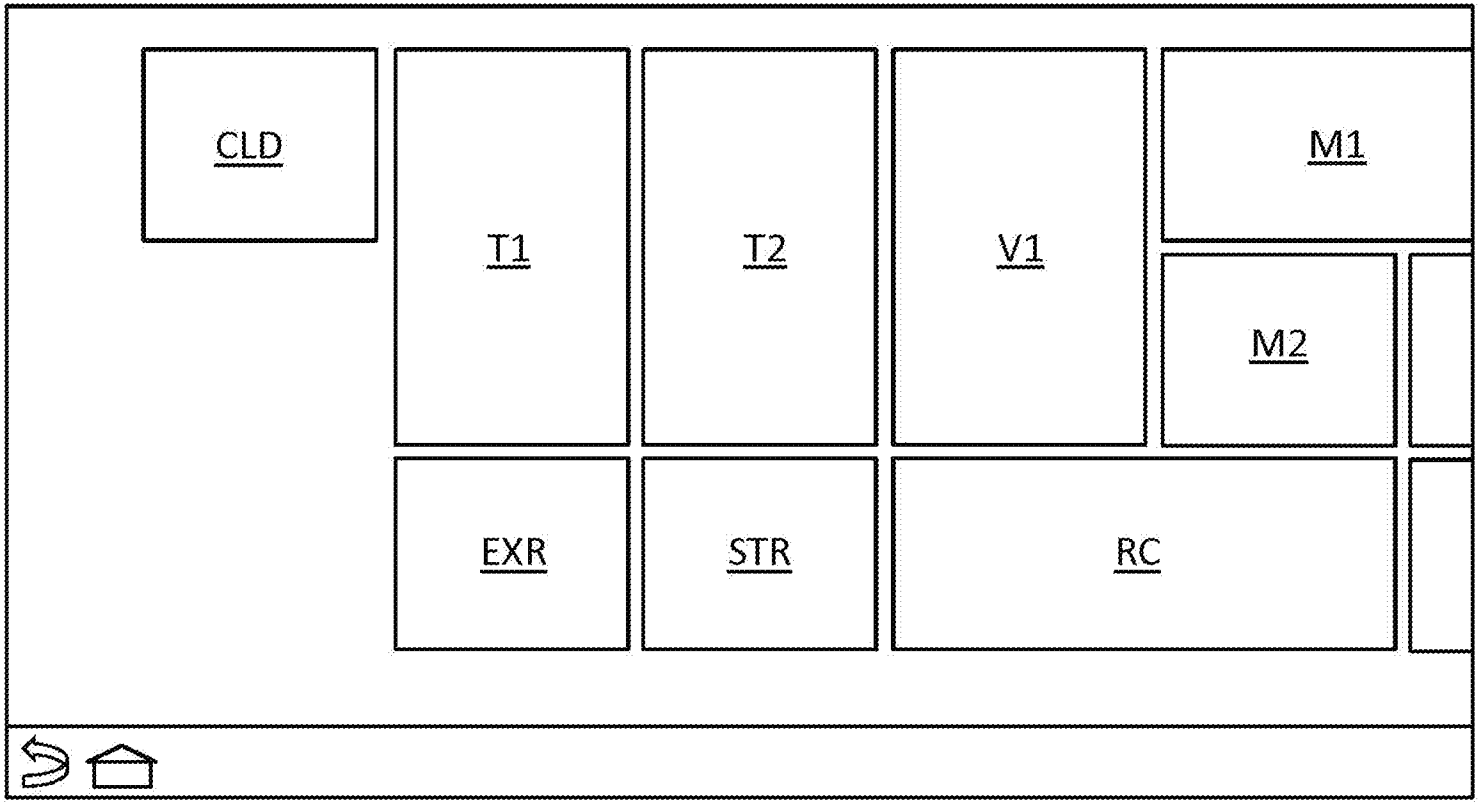

The third screen shown in FIG. 6*c* is, for example, a start menu available to the user to issue commands to the exercise machine 100 by means of the control unit 1, and may be viewed from the exercise machine 100 when the control unit 1 takes the second operating condition in which the user may issue commands to the exercise machine 100.

By way of example, with reference to FIG. 6*c*, the commands which the user may issue to the exercise machine may comprise:

a start command STR which allows the exercise machine 100 to be put into operation, for example, to start the rotation of the belt in case the exercise machine 100 is a treadmill;

an exercise selection command EXR which allows to access a list of predefined workout programs which may be performed on the exercise machine 100;

a cloud access command CLD which allows to access data available in a cloud server, remote with respect to the exercise machine 100;

a first command for setting a first exercise target T1, for example, when the exercise machine 100 is a treadmill, the target workout time;

a second command for setting a second exercise target T2, for example, when the exercise machine 100 is a treadmill, the target workout distance;

a command for changing an operating parameter V1, for example, when the exercise machine 100 is a treadmill, the variation in the rotation speed of the treadmill, therefore, in the workout speed;

a command for accessing a race RC, to allow to access a group training in which the users are competing with each other;

a first command for availing of a first entertainment multimedia content M1 which may be enjoyed during the workout by means of the display module 5, for example, a TV channel;

a second command for availing of a second entertainment multimedia content M2 which may be enjoyed during the workout by means of the display module 5, for example, multimedia films on the Internet;

Returning again to FIGS. 2 and 4, in an embodiment, also shown in FIG. 1, in which the control interface 4 is of the touchscreen type, the display module 5 may coincide with the control interface 4.

It should be noted that in this embodiment, the display module 5 is configured to show the user, in addition to the contents representative of the use of the exercise machine 100 and the multimedia contents for entertainment during the workout (some examples of which have been provided above), also the command interface 4.

In accordance with a further embodiment, alternative to the preceding one and not shown in the Figures, the display module 5 is distinct from the command interface 4.

Figure 2:
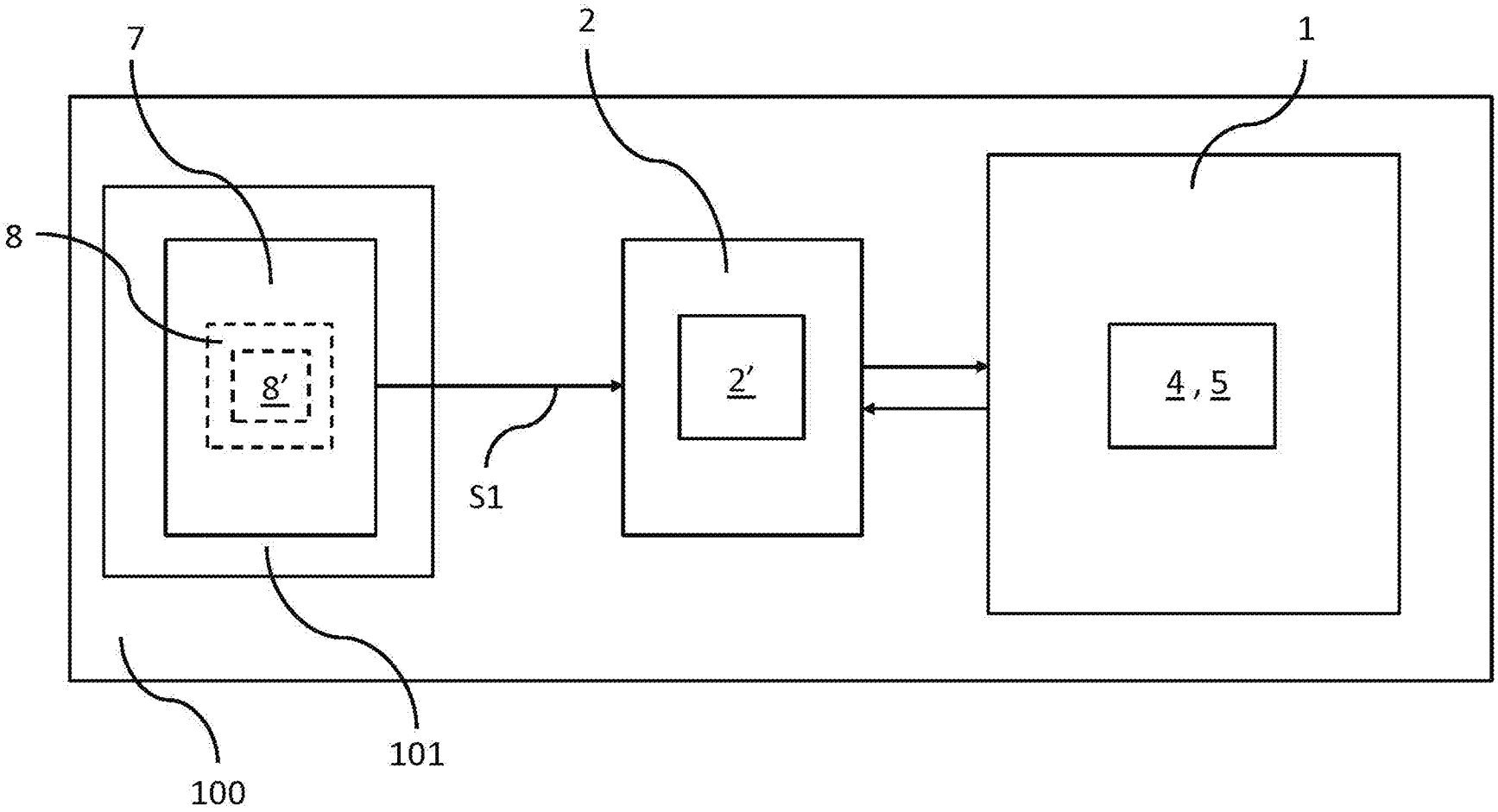
FIG. 2 shows, by means of a block diagram, an exercise machine according to an embodiment of the present invention.

In one embodiment, diagrammatically shown in FIG. 2, the data processing module 2 and the respective memory module 2', integrated, for example, on an electronic board, are external to the control unit 1.

Figure 3:
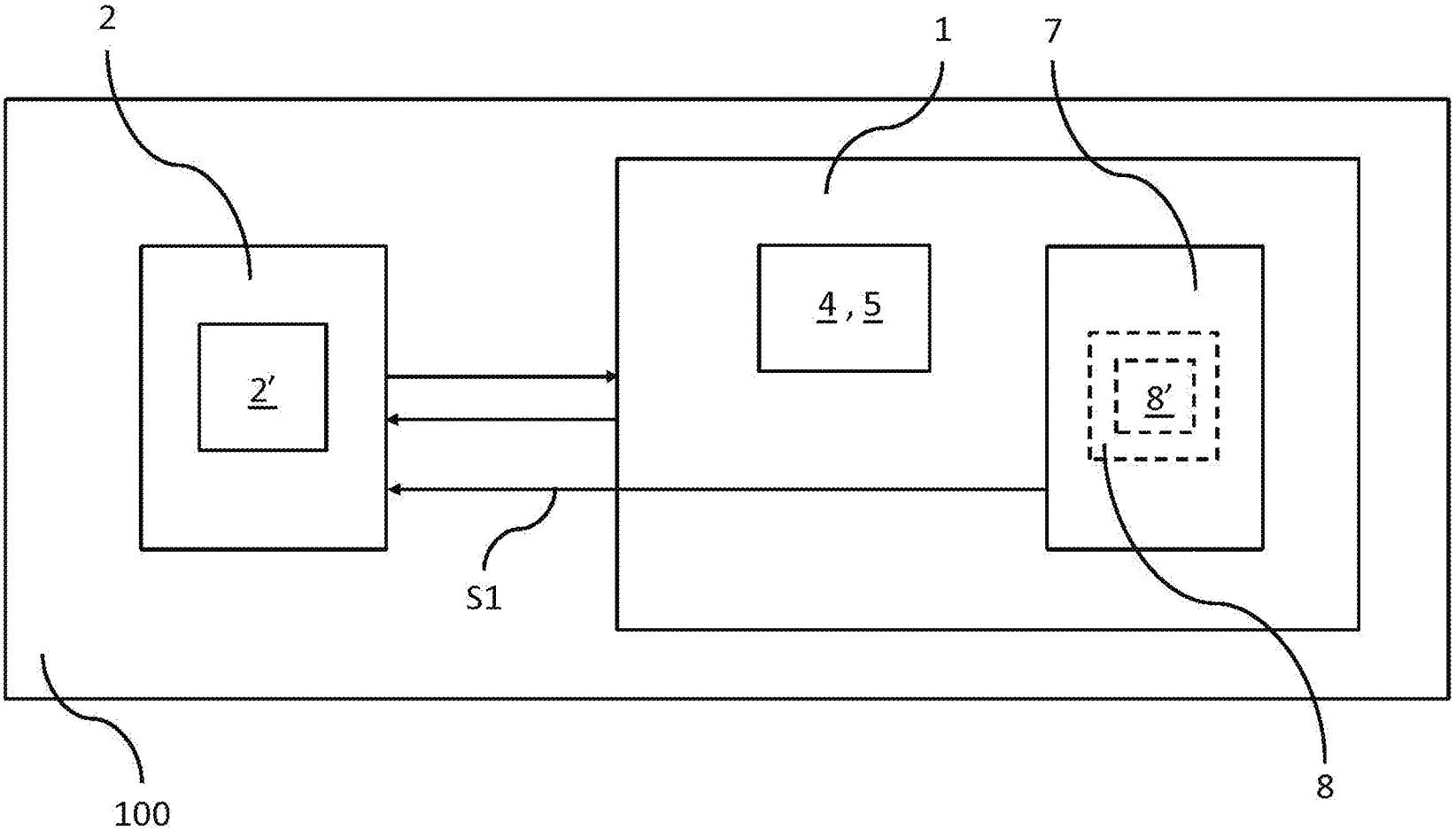
FIG. 3 shows, by means of a block diagram, an exercise machine according to a further embodiment of the present invention.

In accordance with a further embodiment, diagrammatically shown in FIG. 3, the data processing module 2 and the respective memory module 2', integrated, for example, on an electronic board, are housed inside the control unit 1.

Figure 4:
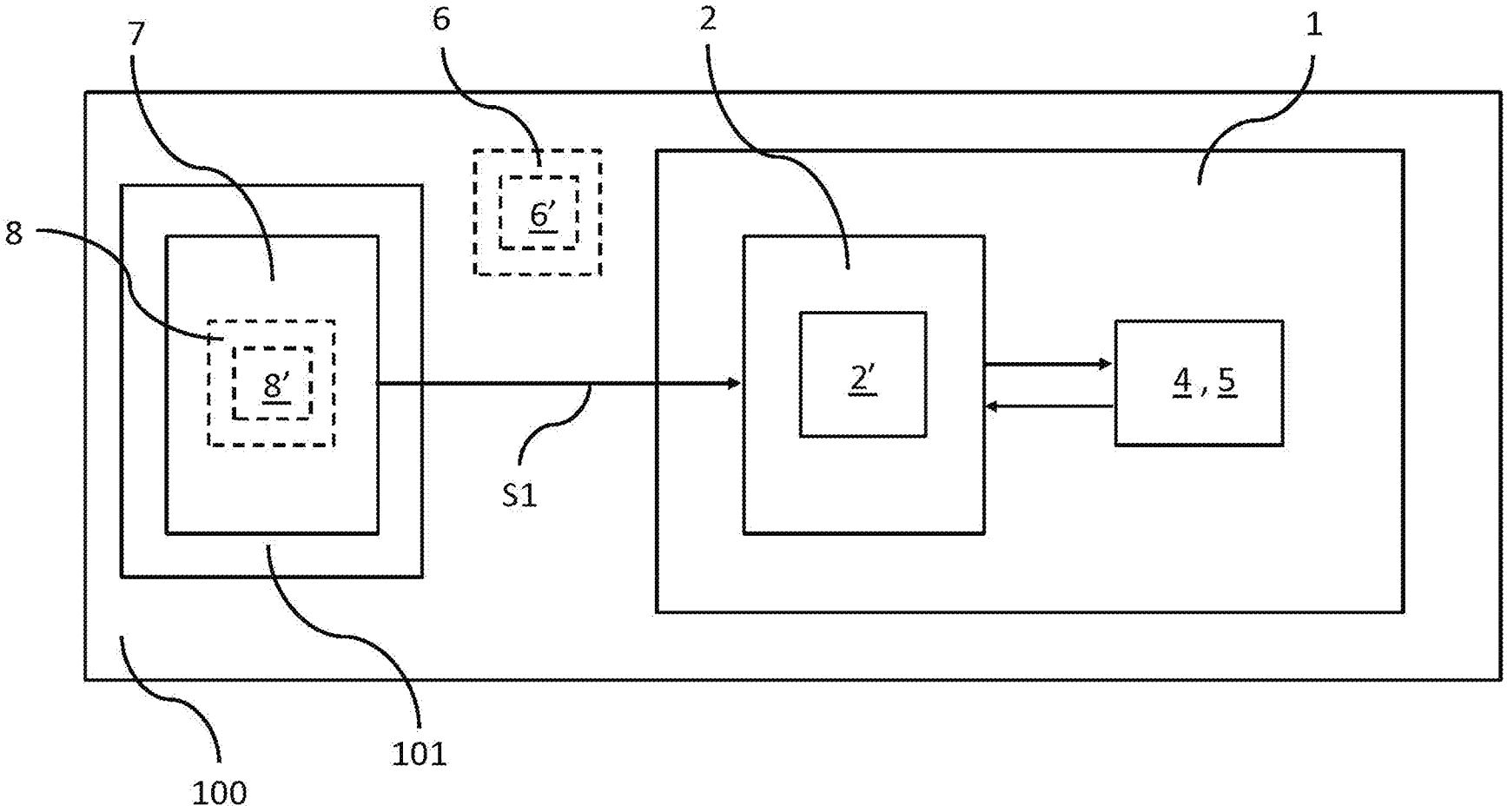
FIG. 4 shows, by means of a block diagram, an exercise machine according to a further embodiment of the present invention.

In accordance with a further embodiment, in combination with the preceding one, shown with dashed lines in FIG. 4, the exercise machine 100 may further comprise a further data processing module 6 and a respective further memory module 6', integrated, for example, on a respective electronic board, external to the control unit 1, distinct from the data processing module 2 and from the memory module 2, housed inside the control unit 1.

The further data processing module 6, by means of the loading and execution of one or more program codes, stored in the further memory module 6', is configured to carry out further operations, the execution of which may be delegated to the exercise machine 100.

In other words, in this embodiment, the further data processing module 6 and the further memory module 6' are a further intelligent component with which the exercise machine 100 is equipped.

Returning in general to the exercise machine 100, in accordance with an embodiment, shown in any of the Figures, it further comprises at least one sensor 7 for detecting the presence of a user on the exercise machine 100, below also a presence detection sensor 7 or simply at least one sensor 7.

The at least one sensor 7 for detecting the presence of the user on the exercise machine 100 is configured to provide at least one electrical signal S1 representative of a detection carried out at the time of the occupation of the exercise machine 100 by the user.

For the purposes of this description, "engagement" of the exercise machine by the user means the positioning of the user on the exercise machine suitable for carrying out the exercise, such as, for example, stepping onto the belt in case the exercise machine 100 is a treadmill, sitting onto a saddle in case the exercise machine 100 is a bike or an exercise bike, sitting onto a seat in case the exercise machine 100 is a muscle-building apparatus.

In a further embodiment, shown with dashed lines in the Figures, the at least one sensor 7 may comprise a respective data processing unit 8, for example, a microcontroller or a microprocessor.

Furthermore, in this embodiment, the at least one sensor 7 comprises a memory unit 8' (also shown with dashed lines in FIG. 3) operatively connected to the data processing unit 8.

The memory unit 8' may be inside (as diagrammatically shown in FIG. 3) or outside the data processing unit 8 (embodiment not shown in the Figures).

The data processing unit 8, by means of the loading and execution of one or more program codes, stored in the memory unit 8', is configured to carry out operations, the execution of which is delegated to the at least one sensor 7.

In other words, in this embodiment, the data processing unit 8 and the memory unit 8' are an intelligent component with which the at least one sensor 7 is equipped.

The at least one presence detection sensor 7 may be any sensor suitable for detecting presence by means of the variation of one or more physical properties, also combined with one another, such as electromagnetic, optical, sound, mechanical ones, which may be found on the exercise machine 100 at the time of a user being present thereon.

In accordance with an embodiment, the at least one presence detection sensor 7 may be an accelerometer configured to detect mechanical vibrations of the exercise machine 100 generated by the occupation of the exercise machine 100 by the user, for example, the stepping onto the belt of a treadmill or the sitting onto a saddle of a bike or an exercise bike.

In this embodiment, the accelerometer is adapted to detect a vibration for each of the three axes of detection of the accelerometer and provides an electrical signal for each of the three axes.

In accordance with a further embodiment, alternative to the preceding one, the at least one presence detection sensor 7 may be an optical sensor, for example infrared, configured to generate an optical beam and detect a component thereof reflected by the user as of the time of occupation of the exercise machine 100 by the user.

In accordance with a further embodiment, alternative to the preceding ones, the at least one presence detection sensor 7 may be a digital camera configured to detect an image of the user present on the exercise machine 100.

In accordance with a further embodiment, alternative to the preceding ones, the at least one presence detection sensor 7 may be an acoustic sensor configured to generate an acoustic wave and detect a component thereof reflected by the user as of the time of occupation of the exercise machine 100 by the user.

In accordance with a further embodiment, alternative to the preceding ones, the at least one presence detection sensor 7 may be an electromagnetic device comprising an emitter for generating an electromagnetic signal and a respective receiver for detecting a component thereof reflected by the user as of the time of occupation of the exercise machine 100 by the user.

In accordance with further embodiments, alternative to the preceding ones, the at least one presence detection sensor 7 may be any combination of the technologies of the embodiments described above or of other technologies equivalent thereto.

Returning in general to the exercise machine 100, it is advantageously configured to switch the control unit 1 from the first locking condition to said at least a second operating condition on the basis of the at least one electrical signal S1 provided by said at least one sensor 7 for detecting the presence of the user on the exercise machine 100.

In other words, as it will be described below in accordance with different embodiments, the exercise machine 100 is configured to carry out a method for unlocking the control unit 1 of the exercise machine 100 at the time of the occupation of the exercise machine 100 by the user.

In particular, the exercise machine 100 is, for example, configured to interpret the at least one electrical signal S1 provided by the at least one presence detection sensor 7, at the time of the occupation of the exercise machine 100 by the user, as an "interrupt" to terminate the first locking condition of the control unit 1 and enable said at least a second operating condition of the control unit 1.

In this regard, in case the control unit 1 is equipped with the display module 5, it should be noted that in the first locking condition, the exercise machine 100 is configured to display on the display module 5 of the control unit 1 a screen representative of the first locking condition, for example, a still image without any graphical content (FIG. 6*a*), preferably dark, or a still or moving screensaver (FIG. 6*b*), or for switching off the display module 5.

Again, in case the control unit 1 is equipped with the display module 5, it should be noted that in said at least a second operating condition, the exercise machine 100 is configured to display on the display module 5 of the control unit 1, a screen representative of said at least a second operating condition, for example, a start menu available to the user to issue commands to the exercise machine 100 by means of the control unit 1.

In case, instead, the at least one electrical signal S1 is no longer supplied, for example following a set period of time, the exercise machine 100 is configured to switch the control unit 1, and therefore the exercise machine 100, from the at least a second operating condition to the first locking condition.

In case the control unit 1 is equipped with the display module 5, the exercise machine 100 is configured to show on the display module 5 the screen representative of the first locking condition (for example, as shown in FIGS. 6*a* and 6*b*) or for switching off the display module 5.

Returning in general to the exercise machine 100, in an embodiment, in combination with any one of those described above, it is configured to establish whether the at least one electrical signal S1 received from the at least one sensor 7 is representative or not of the occupation of the exercise machine 100 by the user.

In fact, the detection which may be carried out by the at least one presence detection sensor 7 may be inaccurate and inclusive of artifacts, even in large numbers.

For example, in case the at least one presence detection sensor 7 is an accelerometer, the exercise machine 100 is configured to establish whether the at least one electrical signal S1 received from the at least one sensor 7 is representative or not of the occupation of the exercise machine 100 by the user, on the basis of the comparison of the at least one electrical signal S1 with a reference threshold value.

In case the at least one electrical signal S1 is greater than or equal to the reference threshold value, the exercise machine 100 is configured to establish that the at least one electrical signal S1 received from the at least one sensor 7 is representative of the occupation of the exercise machine 100 by the user.

In case, instead, the at least one electrical signal S1 is lower than the reference threshold value, the exercise machine 100 is configured to establish that the at least one electrical signal S1 received from the at least one sensor 7 is not representative of the occupation of the exercise machine 100 by the user.

The fact that the exercise machine 100 is capable of establishing that the at least one electrical signal S1 received from the at least one sensor 7 is representative or not of the occupation of the exercise machine 100 by the user advantageously allows the exercise machine 100 to be as immune as possible to artifacts, false positives and recognition errors due to imprecise detection by the at least one presence detection sensor 7, thus avoiding to inadvertently switch the control unit 1 from the first locking condition to the at least a second operating condition in the absence of occupation of the exercise machine 100 by a user.

In fact, in case, for example, the at least one presence detection sensor 7 is an accelerometer, any accidental impact of the exercise machine 100, for example a simple touch inadvertently given by a user passing alongside it, may cause the reference threshold value to be exceeded, since the reference threshold value is unaware of the direction from which the accidental vibration originates.

Furthermore, in case the exercise machine 100 is in a gym with very high music, a sound vibration detected by the accelerometer may be greater than the reference threshold value, therefore, the at least one electrical signal S1 provided by the at least one sensor 7 would erroneously be established as representative of the occupation of the exercise machine 100 by a user.

To improve the sensitivity of the detection and to minimize the errors in recognizing the occupation of the exercise machine 100 by a user, the electrical signal originating from each of the three axes of the accelerometer may be analyzed separately from the exercise machine 100 using spatial filtering techniques so as to take into greater account the vibrations originating from one direction of the triad of directions of the accelerometer rather than from another one.

In case the exercise machine 100 is a treadmill, the exercise machine 100 may filter the most representative direction in the act of occupying the machine, for example, determining it by performing a calibration operation. For example, the at least one sensor 7 may evaluate the vibrations mainly along the most representative direction, so as to avoid that the at least one sensor 7 itself detects so-called false-positive signals, detectable in case a user hits a handle or another part of the exercise machine 100.

Furthermore, to improve the specificity of the detection, algorithms may be used which classify the electrical signal provided by the accelerometer, establishing the state of the "user occupation of the exercise machine" only when compared to a dataset of real vibration patterns.

These techniques provide that such algorithms "learn" on real data how to recognize an actual occupation of the exercise machine 100 by a user, so as to eliminate the cases of error.

Returning in general to the exercise machine 100, in an embodiment, in combination with the one in which the exercise machine 100 comprises the data processing module 2, the step of establishing whether the at least one received electrical signal S1 from the at least one sensor 7 is representative or not of the occupation of the exercise machine 100 by a user is carried out by a data processing module 2 with which the exercise machine 100 may be provided, which is distinct from said at least one sensor 7 for detecting the presence of a user on the exercise machine 100.

In accordance with a further embodiment, alternative to the preceding one, the operation of establishing whether the at least one received electrical signal S1 from the at least one sensor 7 is representative or not of the occupation of the exercise machine 100 by a user is entrusted to the data processing unit 8 with which the at least one presence detection sensor 7 may be provided.

Thereby, the data processing module 2 of the exercise machine 100, from a computational point of view, is relieved of the burden of having to establish whether the at least one electrical signal S1 is representative or not of the occupation of the exercise machine 100 by the user.

With general reference to any one of FIGS. 2-4, in accordance with an embodiment, in combination with any of those described above, the at least one presence detection sensor 7 is operatively connected to the data processing module 2 of the exercise machine 100.

In this regard, the at least one presence detection sensor 7 is operatively connected to the data processing module 2 of the exercise machine 100 in a wireless mode or in a wired mode.

Figure 5:
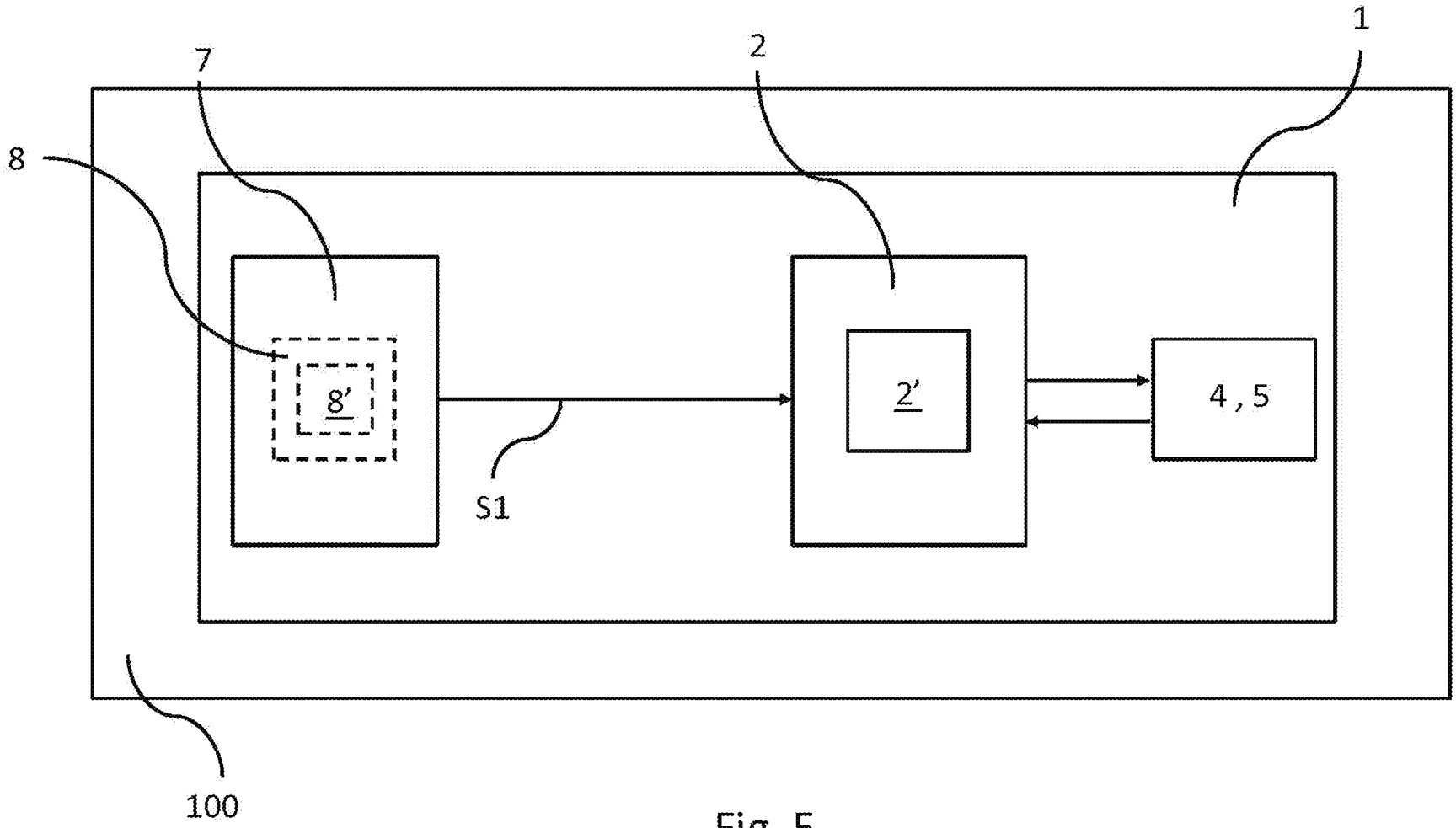
FIG. 5 shows, by means of a block diagram, an exercise machine according to a further embodiment of the present invention.

In accordance with an embodiment, shown, for example, in FIGS. 3 and 5, the at least one presence detection sensor 7 is inside the control unit 1 of the exercise machine 100.

In accordance with a further embodiment, alternative to the preceding one and shown, for example, in FIGS. 2 and 4, the at least one presence detection sensor 7 is outside the control unit 1 of the exercise machine 100.

In a further embodiment, in combination with the preceding one, the at least one presence detection sensor 7 may be integrated inside a component 101 of the exercise machine 100 which is distinct from the control unit 1.

The component 101, diagrammatically shown in FIGS. 2 and 4, may, for example, be a tubular element of the exercise machine 100 or a base portion, in case the exercise machine 100 is a treadmill, in the proximity of a board on which the belt may roll.

Furthermore, according to further embodiments, in combination with any one of those described above, the at least one presence detection sensor 7 may be integrated on the same electronic board on which the data processing module 2 and the respective memory module 2' of the exercise machine 100 are integrated, or be integrated on a further electronic board, distinct from the electronic board on which the data processing module 2 and the respective memory module 2' of the exercise machine 100 are integrated, or it may be installed without the aid of any electronic board.

Figure 7:
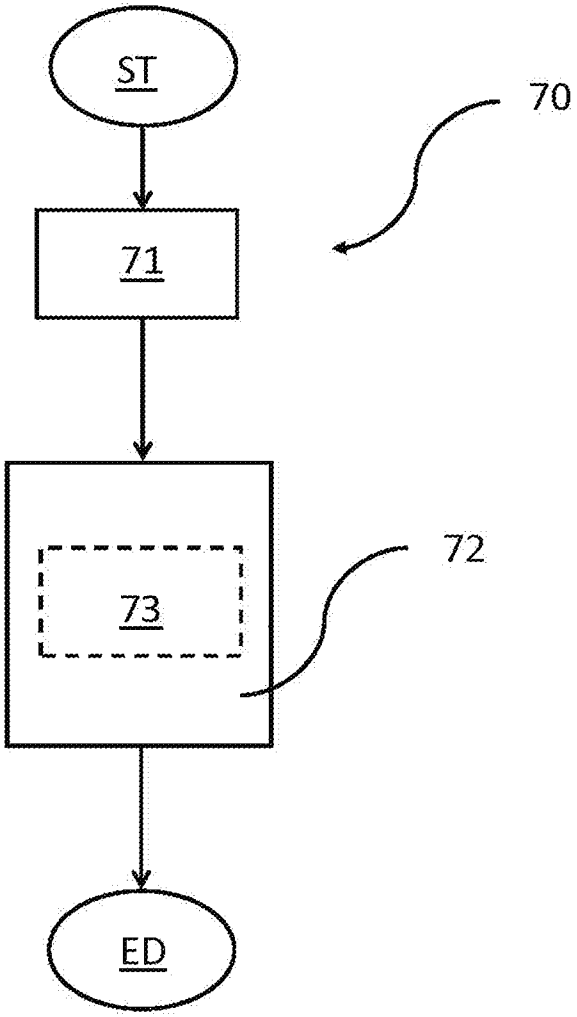
FIG. 7 shows, by means of a block diagram, a method for unlocking a control unit of an exercise machine, according to an embodiment of the present invention.

With reference to FIG. 7, a method 70 is now described for unlocking a control unit 1 of an exercise machine 100, hereinafter also method 70 for unlocking or simply method 70, according to an embodiment of the present invention.

Examples of exercise machines have been described above.

The control unit 1 has been described above according to different embodiments.

The method 70 comprises a symbolic step of starting ST.

The method 70 further comprises a step of providing 71 the exercise machine 100, by at least one sensor 7 for detecting the presence of a user on the exercise machine 100, with at least one electrical signal S1 representative of a detection carried out at the time of the occupation of the exercise machine 100 by a user.

The at least one presence detection sensor 7 has been described above according to different embodiments.

The method 70 further comprises a step of switching 72, by the exercise machine 100, the control unit 1 of the exercise machine 100 from a first locking condition to at least a second operating condition in which the user may issue commands to the exercise machine by means of the control unit 1, on the basis of the at least one electrical signal S1 provided by said at least one sensor 7 for detecting the presence of the user on the exercise machine 100.

The method 150 ends with a symbolic step of ending ED.

In accordance with an embodiment, shown by means of dashed lines in FIG. 7, the step of switching 72 further comprises a step of establishing 73, by the exercise machine 100, whether the at least one received electrical signal S1 from the at least one sensor 7 for detecting the presence of a user on the exercise machine 100 is representative or not of the occupation of the exercise machine 100 by a user.

According to a further embodiment, in combination with the preceding one, shown with dashed lines in FIG. 7, the at least one sensor 7 for detecting the presence of a user on the exercise machine 100 comprises an accelerometer.

In this embodiment, the step of establishing 73 is carried out, by the exercise machine 100, comparing the at least one electrical signal S1 with a reference threshold value.

In case at least one electrical signal S1 is greater than or equal to the reference threshold value, the at least one received electrical signal S1 is established by the exercise machine 100 as representative of the occupation of the exercise machine 100 by a user.

In case, however, the at least one electrical signal S1 is lower than the reference threshold value, the at least one received electrical signal S1 is established by the exercise machine 100 as not representative of the occupation by a user of the exercise machine 100.

In an embodiment, in combination with the preceding ones, the step of establishing 73 whether the at least one received electrical signal S1 from the at least one sensor 7 for detecting the presence of a user on the exercise machine 100 is representative or not of the occupation of the exercise machine 100 by a user is carried out by a data processing module 2 with which the exercise machine 100 may be provided, which is distinct from said at least one sensor 7 for detecting the presence of a user on the exercise machine 100.

In accordance with an embodiment, alternative to the preceding one, the step of establishing 73 whether the at least one received electrical signal S1 from the at least one sensor 7 for detecting the presence of a user on the exercise machine 100 is representative or not of the occupation of the exercise machine 100 by a user on the exercise machine 100 is carried out by a data processing unit 8 with which the at least one sensor 7 for detecting the presence of a user on the exercise machine 100 may be provided.

In accordance with an embodiment, in combination with any one of those described above, the at least one sensor 7 for detecting the presence of a user on the exercise machine 100 is inside the control unit 1 of the exercise machine 100.

In accordance with a further embodiment, alternative to the preceding one, the at least one presence detection sensor 7 is outside the control unit 1 of the exercise machine 100.

In accordance with a further embodiment, in combination with the preceding one, the at least one presence detection sensor 7 may be integrated inside a component 101 of the exercise machine 100 which is distinct from the control unit 1.

With reference to an embodiment and to FIGS. 1, 5, **6*a*-6*c*, an example of implementation by means of an exercise machine 100 is now described, of a method for unlocking a control unit 1 of an exercise machine 100**.

The exercise machine 100, for example a treadmill, is in stand-by mode.

Therefore, the control unit 1 is in the first locking condition and the display module 5 of the control unit 1 is switched off (FIG. **6*a*) or in a screensaver mode (of which a frame is shown in FIG. 6*b***).

A user occupies the exercise machine 100 (in the case of the treadmill, the user steps onto the belt) and generates mechanical vibrations in the exercise machine 100 which are detected by the at least one presence detection sensor 7, for example an accelerometer, which supplies the exercise machine 100 with the at least one electrical signal S1.

The exercise machine 100 establishes whether the at least one electrical signal S1 is representative or not of the occupation of the exercise machine 100 by the user by comparing the at least one electrical signal S1 with a reference threshold value.

Established that the at least one electrical signal S1 is greater than the reference threshold value, and therefore the actual occupation of the exercise machine 100 by the user, the exercise machine 100 switches the control unit 1 from the first locking condition to the at least a second operating condition in which the user is enabled to issue commands to the exercise machine 100 by means of the control unit 1.

The display module 5 of the control unit 1 shows the user a screen representative of the second operating condition (for example, FIG. 6*c*), or a start menu.

The control interface 4 of the control unit 1 coincides with the display module 5 (in touchscreen mode).

From this moment onwards, the user issues commands to the control unit 1 by means of the control interface 4 integrated in the display module 5.

Once the user has finished training and has freed the exercise machine 100, once a set period of time has also elapsed without any detection of the presence of a user, the exercise machine 100 switches the control unit 1 from the least a second operating condition to the first locking condition.

As may be seen, the object of the invention is fully achieved.

In fact, the method for unlocking the control unit 1 of the exercise machine 100 advantageously allows to automatically switch the control unit 1 from a first locking condition to at least a second operating condition at the time when the occupation of the exercise machine 100 by a user is detected, avoiding that a user has to manually intervene to unlock the control unit 1.

Furthermore, in one embodiment, the fact that the method establishes whether the at least one electrical signal S1, provided by the at least one presence detection sensor 7, is representative or not of the occupation of the exercise machine 100 by a user advantageously allows to avoid false alarms, considerably improving the reliability of the exercise machine 100.

In order to meet contingent needs, those skilled in the art may modify and adapt the embodiments of the method described above, and replace elements with others which are functionally equivalent, without departing from the scope of the following claims. Each of the features described as belonging to a possible embodiment may be achieved irrespective of the other embodiments described.

The invention claimed is:

1. A method for unlocking a control unit of an exercise machine, comprising steps of:

providing the exercise machine, having an accelerometer for detecting a presence of a user on the exercise machine, the accelerometer providing at least one electrical signal;

establishing by the exercise machine whether the at least one electrical signal received from the accelerometer is representative or not of actual occupation of the exercise machine by the user by analyzing with filtering the at least one electrical signal to obtain a filtered signal and comparing the filtered signal with a reference threshold value;

switching, by the exercise machine, the control unit of the exercise machine from a first locking condition to at least a second operating condition in which the user may issue commands to the exercise machine by the control unit, based on establishing that the at least one electrical signal received from the accelerometer is representative of the actual occupation of the exercise machine by the user.

2. The method according to claim 1, wherein, if the filtered electrical signal is greater than or equal to the reference threshold value, the at least one received electrical signal is established by the exercise machine as being representative of the actual occupation of the exercise machine by the user; and wherein, if the filtered electrical signal is less than the reference threshold value, the at least one received electrical signal is established by the exercise machine as being not representative of the occupation of the exercise machine by the user.

3. The method according to claim 2, wherein the step of establishing whether the at least one received electrical signal from the accelerometer is representative or not of the actual occupation of the exercise machine by the user is carried out by a data processing module with which the exercise machine is provided, which is distinct from said accelerometer.

4. The method according to claim 2, wherein the step of establishing whether the at least one received electrical signal from the accelerometer is representative or not of the actual occupation of the exercise machine by the user is carried out by a data processing unit with which the accelerometer for detecting the presence of the user on the exercise machine is provided.

5. The method according to claim 1, wherein the accelerometer is outside the control unit of the exercise machine.

6. The method according to claim 5, wherein the accelerometer is integrated inside a component of the exercise machine and is distinct from the control unit.

7. The method according to claim 1, wherein the accelerometer detects a vibration for each of three directions along three axes of detection and generates an electric signal of the at least one electric signal for each of the directions.

8. The method according to claim 7, wherein the filtering comprises spatial filtering of the electrical signals for each of the directions to obtain a filtered signal representing vibrations originating from one direction.

9. The method according to claim 1, wherein the step of establishing whether the at least one received electrical signal from the accelerometer is representative or not of the actual occupation of the exercise machine by the user is carried out by a data processing module with which the exercise machine is provided, which is distinct from said accelerometer.

10. The method according to claim 1, wherein the step of establishing whether the at least one received electrical signal from the accelerometer is representative or not of the actual occupation of the exercise machine by the user is carried out by a data processing unit with which the accelerometer for detecting the presence of the user on the exercise machine is provided.

11. The method according to claim 1, wherein the accelerometer is inside the control unit of the exercise machine.

12. The method according to claim 1, wherein the filtering comprises spatial filtering of the at least one electrical signal.

13. The method according to claim 1, wherein the filtering comprises spatial filtering of the at least one electrical signal to obtain a filtered signal indicative of vibrations originating from one direction.

14. An exercise machine comprising:

a control unit operable by a user to issue commands to the exercise machine, the control unit being configured to have a first locking condition and at least a second operating condition in which the user may issue commands to the exercise machine by the control unit;

an accelerometer for detecting a presence of the user on the exercise machine, the accelerometer for detecting the presence of the user on the exercise machine being configured to provide the exercise machine with at least one electrical signal;

the exercise machine being configured to:

establish whether the at least one electrical signal received from the accelerometer is representative or not of actual occupation of the exercise machine by the user by analyzing with filtering the at least one electrical signal to obtain a filtered signal and comparing the filtered signal with a reference threshold value;

switch the control unit of the exercise machine from the first locking condition to at least the second operating condition in which the user may issue commands to the exercise machine by the control unit, based on establishing that the at least one electrical signal received from the accelerometer is representative of the actual occupation of the exercise machine by the user.

15. The exercise machine according to claim 14, wherein, if the filtered electrical signal is greater than or equal to the reference threshold value, the at least one received electrical signal is established by the exercise machine as being representative of the actual occupation of the exercise machine by the user; and wherein, if the filtered electrical signal is less than the reference threshold value, the at least one received electrical signal is established by the exercise machine as being not representative of the occupation of the exercise machine by the user.

* * * * *